US011829101B2

(12) United States Patent
Fujita et al.

(10) Patent No.: US 11,829,101 B2
(45) Date of Patent: Nov. 28, 2023

(54) IMAGE FORMING APPARATUS WITH SEPARATELY CONTROLLABLE AIRFLOW FOR EXHAUST OF OZONE AND TONER PARTICLES

(71) Applicant: CANON KABUSHIKI KAISHA, Tokyo (JP)

(72) Inventors: Takashi Fujita, Chiba (JP); Hideto Abe, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/863,014

(22) Filed: Jul. 12, 2022

(65) Prior Publication Data

US 2023/0021525 A1 Jan. 26, 2023

(30) Foreign Application Priority Data

Jul. 20, 2021 (JP) ..... 2021-119206
May 31, 2022 (JP) ..... 2022-088180

(51) Int. Cl.
*G03G 21/00* (2006.01)
*G03G 21/20* (2006.01)
*G03G 15/02* (2006.01)

(52) U.S. Cl.
CPC ..... *G03G 21/206* (2013.01); *G03G 15/0258* (2013.01); *G03G 2221/1645* (2013.01)

(58) Field of Classification Search
CPC ..... G03G 15/0258; G03G 21/206; G03G 2221/1645
USPC ..... 399/92, 93
See application file for complete search history.

(56) References Cited

U.S. PATENT DOCUMENTS 5,130,743 A * 7/1992 Katoh ..... G03D 13/007 355/405
7,313,342 B2 * 12/2007 Katayama ..... G03G 21/206 399/93
7,620,342 B2 * 11/2009 Sata ..... G03G 21/206 399/92
9,977,400 B2 * 5/2018 Yamaguchi ..... G03G 21/206
10,877,436 B2 * 12/2020 Kabata ..... G03G 15/0258
2005/0244178 A1 * 11/2005 Kitayama ..... G03G 21/206 399/92

(Continued)

FOREIGN PATENT DOCUMENTS

JP 2004354663 A * 12/2004
JP 6594058 B2 10/2019
JP 2020187283 A * 11/2020 ..... G03G 21/206

OTHER PUBLICATIONS

U.S. Appl. No. 17/837,714, filed Jun. 10, 2022.

*Primary Examiner* — Robert B Beatty
(74) *Attorney, Agent, or Firm* — Venable LLP

(57) ABSTRACT

An image forming apparatus includes a first air suction port sucking an air containing ozone, a second air suction port sucking an air containing the scattered toner, and a duct unit partitioned into a first duct passing through the air containing ozone and a second duct passing through the air containing toner. The duct includes a first fan generating a first air flow inside the first duct to suck the air from the first air suction port and a second fan generating a second air flow inside the second duct to suck the air from the second air suction port. An ozone filter is detachably provided to both the first and second ducts, disposed straddling the first and second ducts, and filters the ozone contained in the first and second air flows.

20 Claims, 10 Drawing Sheets

(56) References Cited

U.S. PATENT DOCUMENTS

| | | | | |
|---|---|---|---|---|
| 2010/0166451 | A1* | 7/2010 | Von Schischka | G03G 21/206 399/98 |
| 2014/0294427 | A1* | 10/2014 | Goda | G03G 21/206 399/99 |
| 2015/0110518 | A1* | 4/2015 | Nagamori | G03G 21/206 399/92 |
| 2015/0346684 | A1* | 12/2015 | Sasaki | G03G 21/203 399/92 |
| 2018/0059601 | A1 | 3/2018 | Abe et al. | G03G 15/00 |
| 2018/0136602 | A1* | 5/2018 | Hashimura | G03G 21/206 |

* cited by examiner (a)

(b)

(c)

IMAGE FORMING APPARATUS WITH SEPARATELY CONTROLLABLE AIRFLOW FOR EXHAUST OF OZONE AND TONER PARTICLES

FIELD OF THE INVENTION AND RELATED ART

The present invention relates to an image forming apparatus using electrophotographic technology, such as a printer, copier, FAX machine or multifunction machine.

As an image forming apparatus, a corona-charging type image forming apparatus has been proposed in the past. In the corona charging method, a corona charger generates a corona discharge to charge the surface of a photosensitive member, and ozone is generated as a byproduct of the corona discharge. However, ozone may corrode, for example, a grid of a corona charger. Therefore, a duct is installed near the corona charger, and an air flow is formed in the duct by a fan so that ozone discharged from the corona charger by air is sent to an ozone filter installed in the duct and collected. Ozone filters, for example, use a catalyst to decompose ozone into oxygen or adsorb ozone on activated carbon.

An image forming apparatus has a developer that develops an electrostatic latent image formed on a photosensitive member using toner. Because the developer uses toner, the toner tends to scatter. And because the developer is installed relatively close to the corona charger, toner may be mixed in the airflow to exhaust air near the corona charger, and ozone may be mixed in an airflow to exhaust air near the developer. Therefore, in Japanese Patent No. 6594058, airflow for exhausting air near the corona charger and airflow for exhausting air near the developer are consolidated via a consolidated duct in order to share parts and reduce the size of the image forming apparatus. A toner filter and ozone filter and one fan that generates airflow to exhaust air near the corona charger and airflow to exhaust air near the developer are located in the consolidated duct.

However, for more efficient collection of ozone or toner, it is preferable to have a configuration that allows independent control of an airflow for exhausting the air near the corona charger and the airflow for exhausting the air near the developer. In the case of the device described in Japanese Patent No. 6594058, it was difficult to control each air flow independently because one fan was used to generate the air flow for exhausting the air near the corona charger and the air flow for exhausting the air near the developer.

The present invention aims to provide an image forming apparatus that allows separate control of each air flow, even when a filter that passes through the air flow to exhaust air near a developer and a filter that passes through the air flow to exhaust air near the developer are common.

SUMMARY OF THE INVENTION

A principal object of the present invention is to provide an image forming apparatus for forming an image on a recording material comprising: an image forming unit provided with a photosensitive member to be rotationally driven, a corona charging device for charging the photosensitive member, an exposing device for forming an electrostatic latent image on the charged photosensitive member, and a developing device for developing the electrostatic latent image formed on the photosensitive member by using toner into a toner image; a first air suction port configured to suck an air containing ozone generated by charging of the photosensitive member by the charging device; a second air suction port configured to suck an air containing the toner scattered when the developing device develops the electrostatic latent image; a duct unit configured to guide the air sucked by the first air suction port and the second air suction port to an outside of the image forming apparatus, the duct including a first duct communicating with the first air suction port and a second duct communicating with the second air suction port; a first fan configured to generate a first air flow inside the first duct to suck the air from the first air suction port; a second fan configured to generate a second air flow inside the second duct to suck the air from the second air suction port; and an ozone filter detachably provided to both the first duct and the second duct, disposed straddling the first duct and the second duct, and configured to filter the ozone contained in the first air flow and the second air flow.

Further features of the present invention will become apparent from the following description of exemplary embodiments with reference to the attached drawings.

Figure 6:
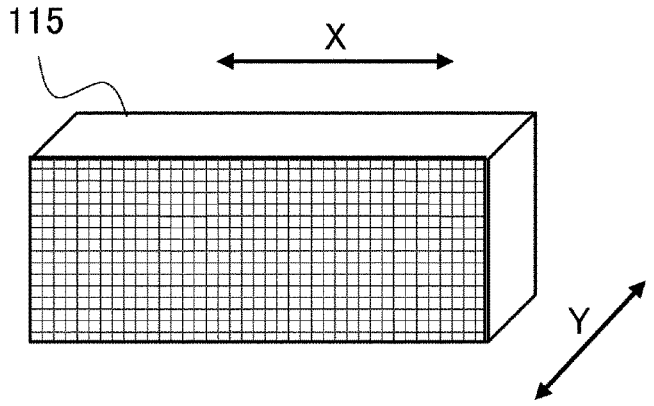
Figure 6:
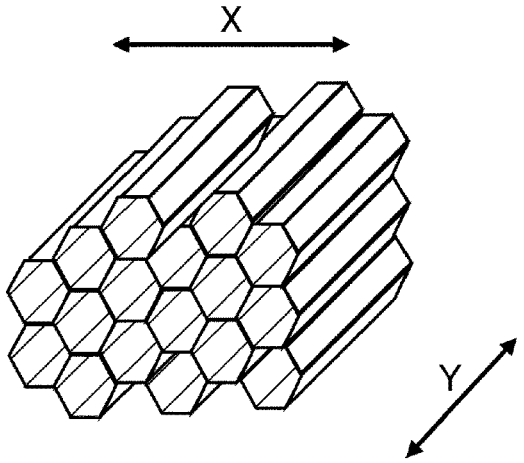
Figure 6:
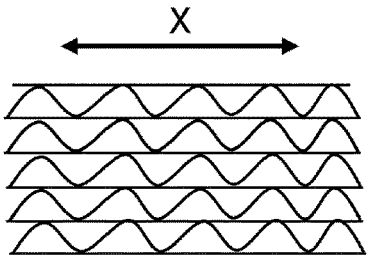

Part (a) of FIG. 6 is a perspective view showing an ozone filter, Part (b) of FIG. 6 is a perspective view showing an example of a cross-sectional shape of an ozone filter, and Part (c) of FIG. 6 is a cross-sectional view showing another example of a cross-sectional shape of an ozone filter.

Figure 7:
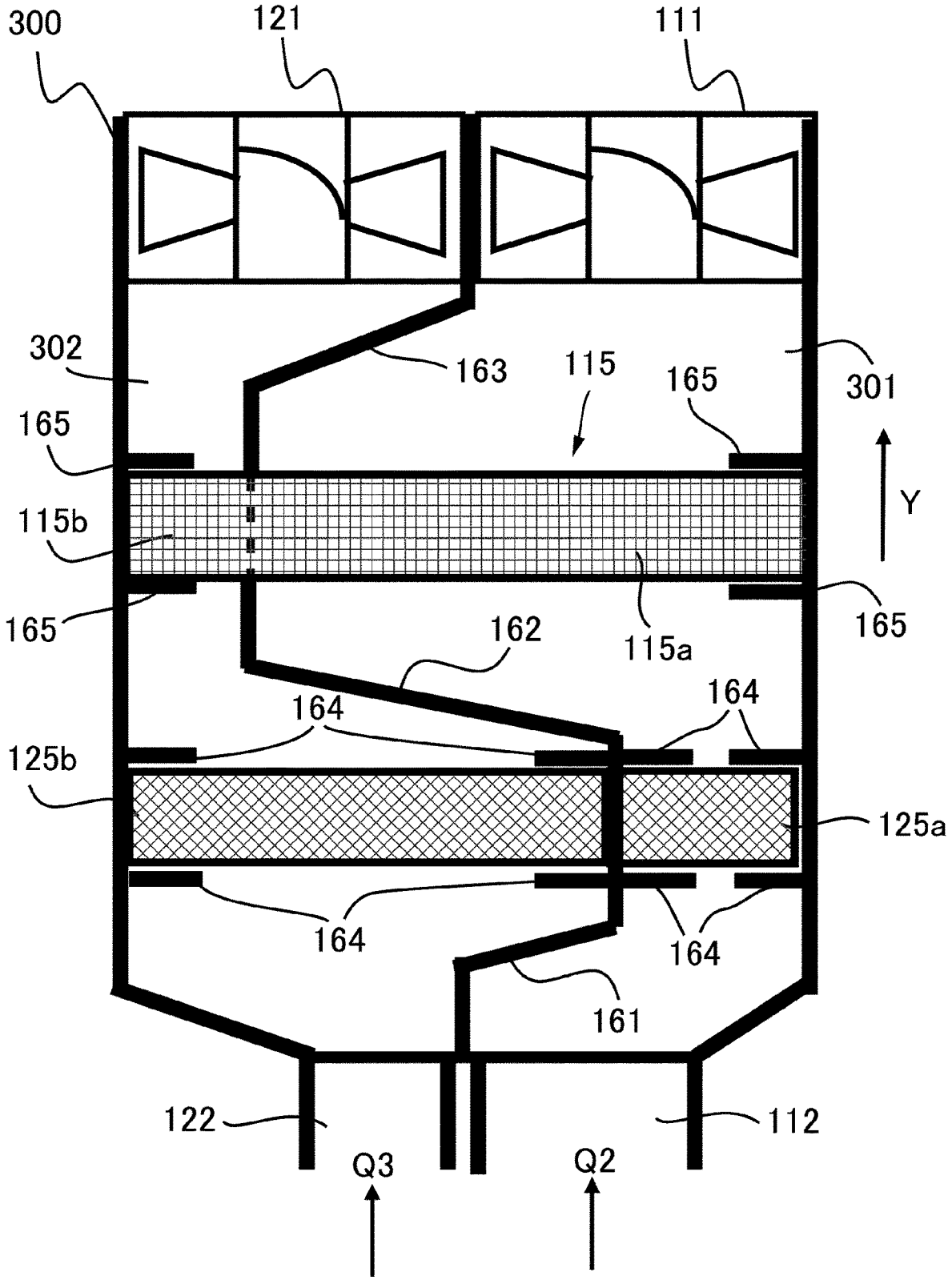

FIG. 7 is a cross-sectional view showing a duct unit with different toner filter cross-sectional area ratios.

Figure 8:
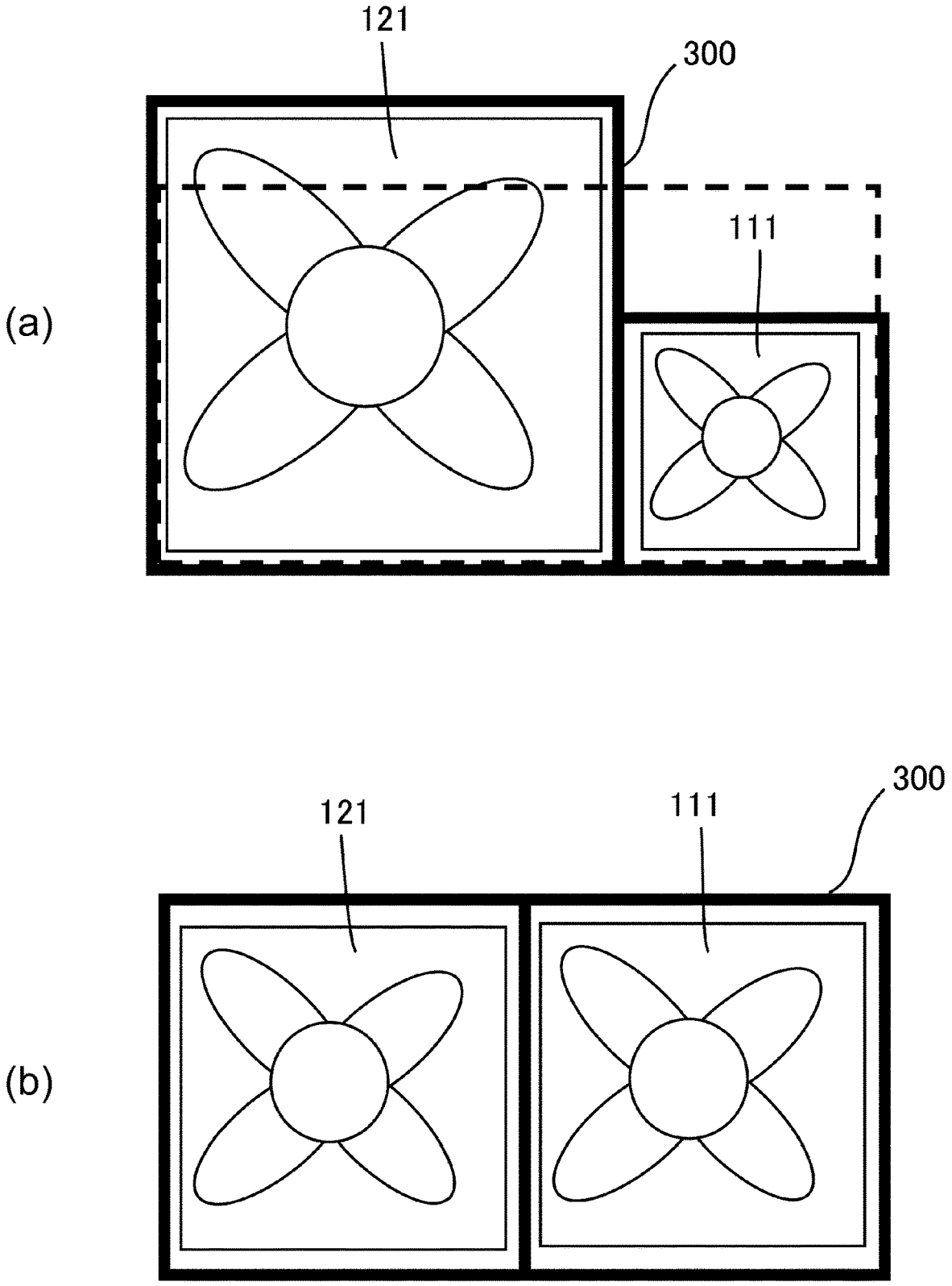

Part (a) of FIG. 8 is a drawing showing an arrangement of fans of different sizes, and Part (b) of FIG. 8 is a drawing showing an arrangement when the fans are the same size.

Figure 9:
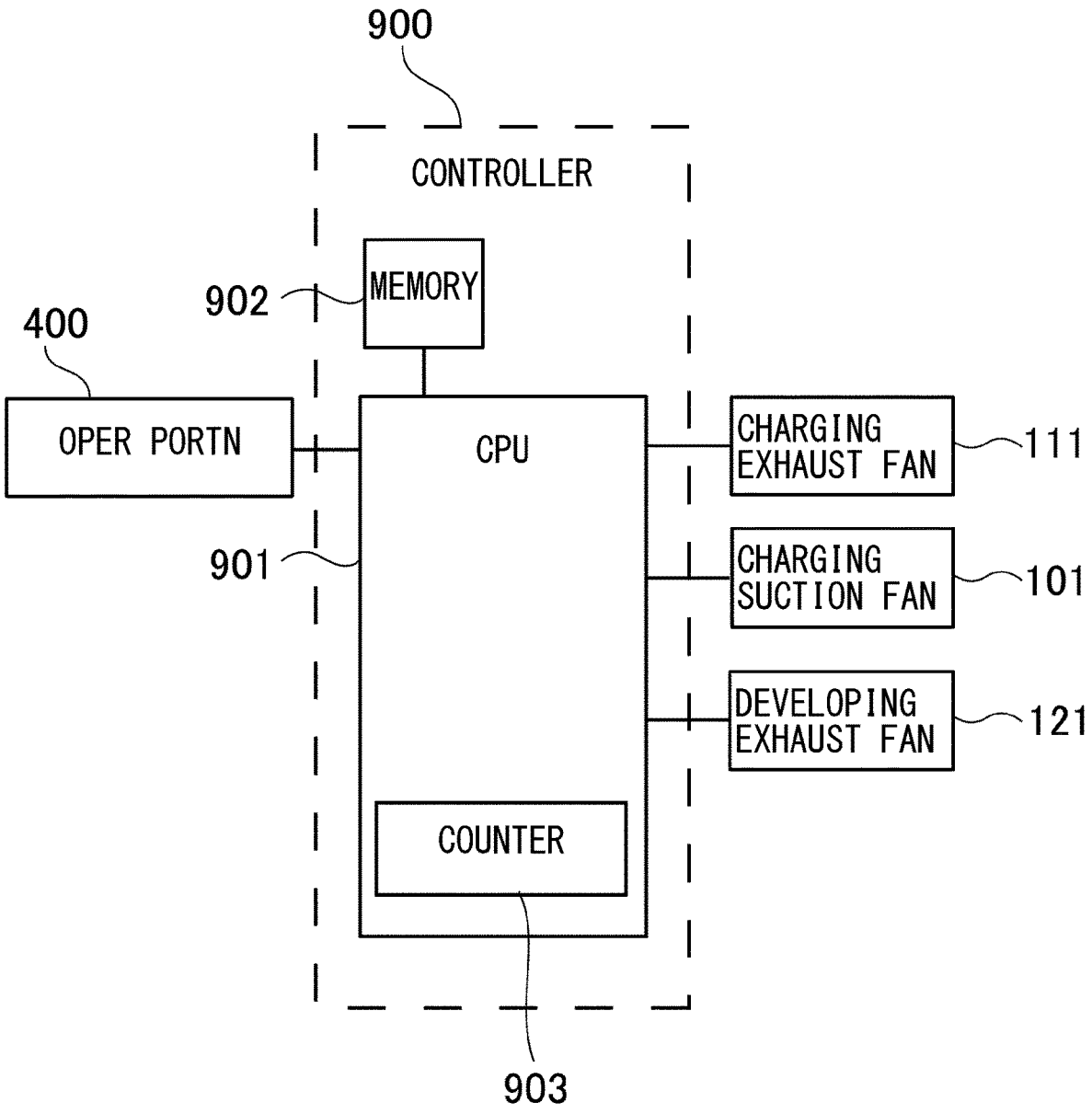

FIG. 9 is a control block diagram showing a control portion.

Figure 10:
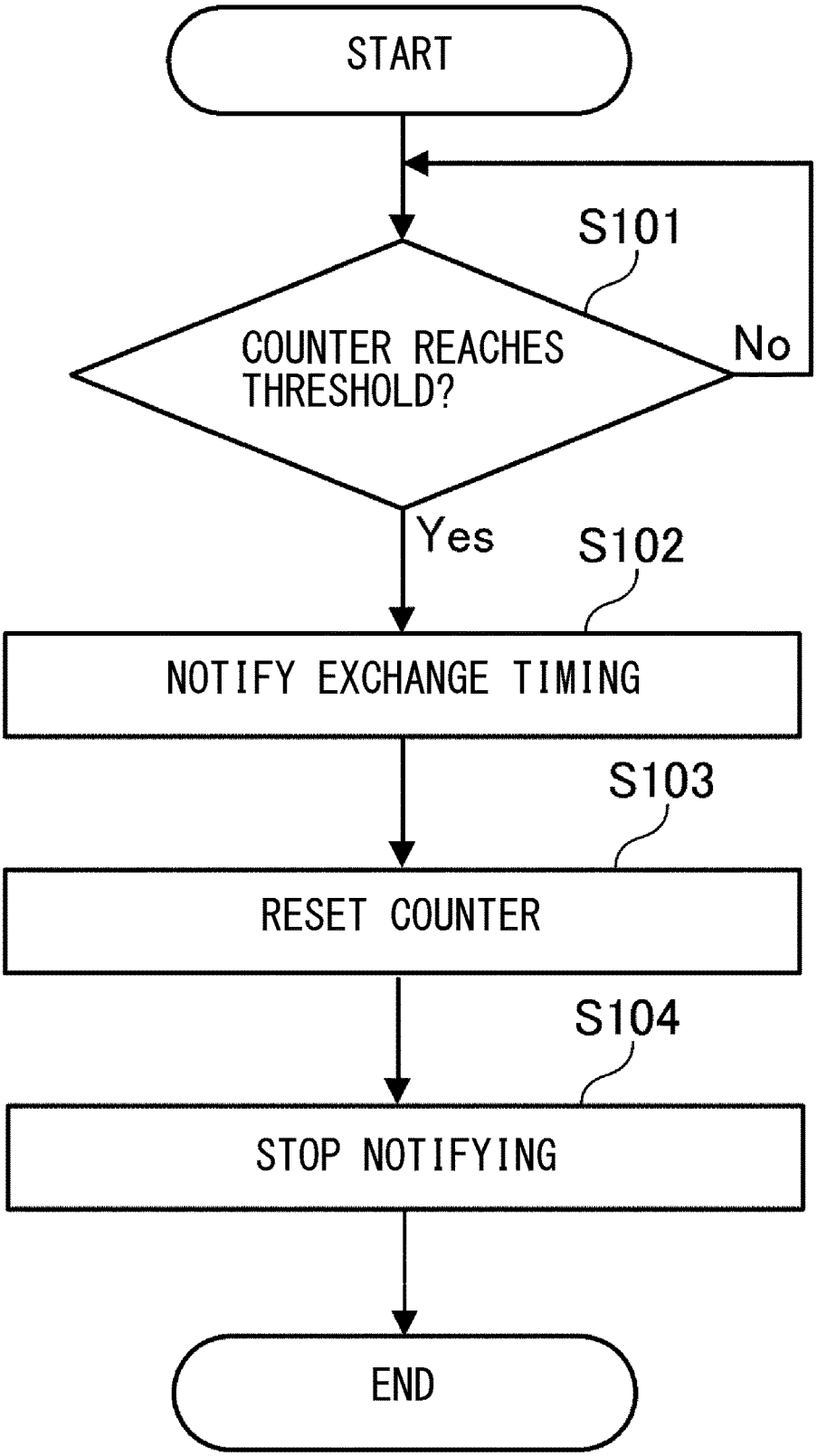

FIG. 10 is a flowchart showing a filter replacement notification process.

DESCRIPTION OF THE EMBODIMENTS

<Image Forming Apparatus>

Figure 1:
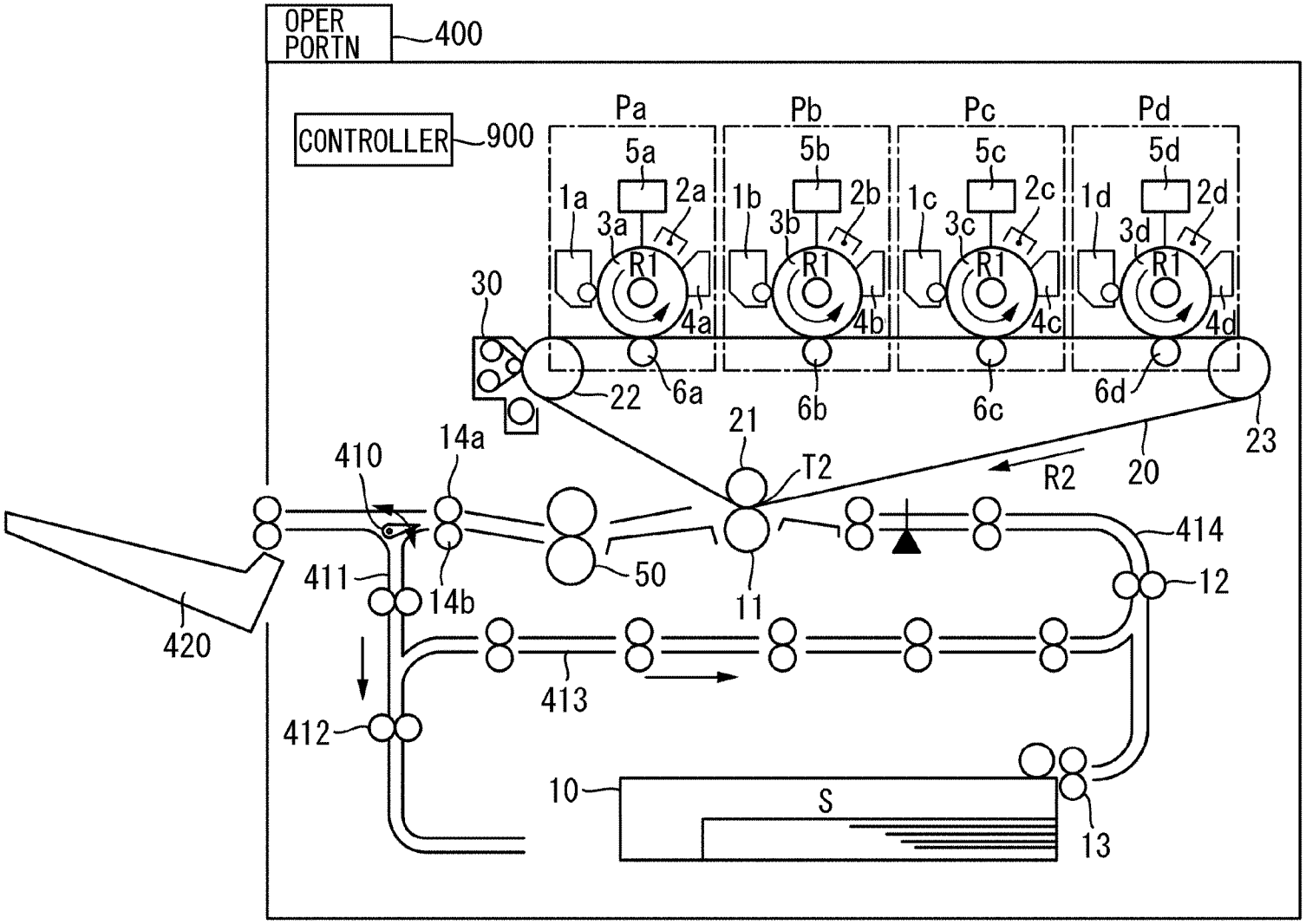
FIG. 1 is a schematic view of an image forming apparatus according to the present embodiment.

The present embodiment is described below. First, an image forming apparatus of the present embodiment is explained using FIG. 1. An image forming apparatus 100 shown in FIG. 1 is an intermediate transfer tandem full-color printer with yellow, magenta, cyan, and black image forming portions Pa, Pb, Pc, and Pd arranged along an intermediate transfer belt 20. Recording material S is available for use with the image forming apparatus 100 include, for example, plain paper, thick paper, rough paper, uneven paper, and coated paper.

A feeding process of a recording material in the image forming apparatus 100 is described below. The recording material S is loaded in a paper feeding cassette 10 and fed from the paper feeding cassette 10 by a paper feeding roller 13 in accordance with an image forming timing. The recording material S fed by the paper feeding roller 13 is fed to a resist roller 12 located in the middle of a feeding path 414. After skew correction and timing correction of the recording material S at the resist roller 12, the recording material S is sent to a secondary transfer portion T2. The secondary transfer portion T2 is a transfer nip portion formed by a secondary transfer inner roller 21 and a secondary transfer outer roller 11, for example, to transfer the toner image onto the recording material in response to the application of secondary transfer voltage to a secondary transfer outer roller 11.

For the feeding process of the recording material S up to the secondary transfer portion T2 described above, the image forming process of the image sent to the secondary transfer portion T2 at the same timing will be described. First, the image forming portions Pa, Pb, Pc, and Pd of each color are configured in almost the same way, except that the toner colors used in developing devices 1*a*, 1*b*, 1*c*, and 1*d* are different: yellow, magenta, cyan, and black. Therefore, we will explain the yellow image forming portion Pa as a representative, and omit explanations of other image forming portions Pb, Pc, and Pd.

The image forming portion Pa consists mainly of a developing device 1*a*, a charging device 2*a*, a photosensitive drum 3*a*, a photosensitive drum cleaner 4*a*, and an exposing device 5*a*. The photosensitive drum 3*a* as a photosensitive member, which is driven to rotate in the direction of an arrow R1 in the figure, is uniformly charged on its surface by a charging device 2*a* and then driven by an exposing device 5*a* based on an image information signal, thus an electrostatic latent image is formed. In the present embodiment, the charging device 2*a* is a corona charging device. Next, an electrostatic latent image formed on a photosensitive drum 3*a* is developed into a toner image by a developing device 1*a* using a developer. The toner image formed on the photosensitive drum 3*a* is then primary transferred onto an intermediate transfer belt 20 in response to the application of primary transfer voltage to a primary transfer roller 6*a*, which is positioned between the image forming portion Pa and the intermediate transfer belt 20. The small amount of primary transfer residual toner remaining on a photosensitive drum 3*a* is collected by a photosensitive drum cleaner 4*a*. In the present embodiment, image forming portions Pa to Pd are examples of image forming units.

The intermediate transfer belt 20 is tensioned by a secondary transfer inner roller 21, a tension roller 22, and a tension roller 23, and is driven in a direction of arrow R2 in the figure. The image forming process for each color processed in parallel by image forming portions Pa to Pd is performed at the timing of sequential superimposition on the toner image of the upstream color that has been primary transferred on the intermediate transfer belt 20. As a result, a full-color toner image is finally formed on the intermediate transfer belt 20 and transferred to the secondary transfer portion T2. The secondary transfer residual toner after passing through the secondary transfer portion T2 is collected by a belt cleaner device 30.

With the feeding process and image forming process described above, respectively, the timing of the recording material S and the full-color toner image is matched in the secondary transfer portion T2, and the secondary transfer is performed. The recording material S is then fed to a fixing device 50, where the toner image is fixed on the recording material by applying a prescribed pressure and heat. After the toner image is fixed in this way, the recording material S is fed between ejection rollers 14*a* and 14*b* and ejected directly onto an ejection tray 420 in the single-sided print mode. On the other hand, in the case of double-sided image formation, a switching flapper 410 switches the feeding path from the path leading to the paper ejection tray 420 to a double-sided feeding path 411, and the recording material S fed between the ejection rollers 14*a* and 14*b* is sent to the double-sided feeding path 411. Thereafter, the leading and trailing ends are switched by a reversing roller 412, and the image is sent back to a feeding path 414 via a double-sided feeding path 413. The subsequent feeding process and the backside (second side) image forming process are the same as described above, so these processes will not be described here.

<Air Flow Configuration>

Figure 2:
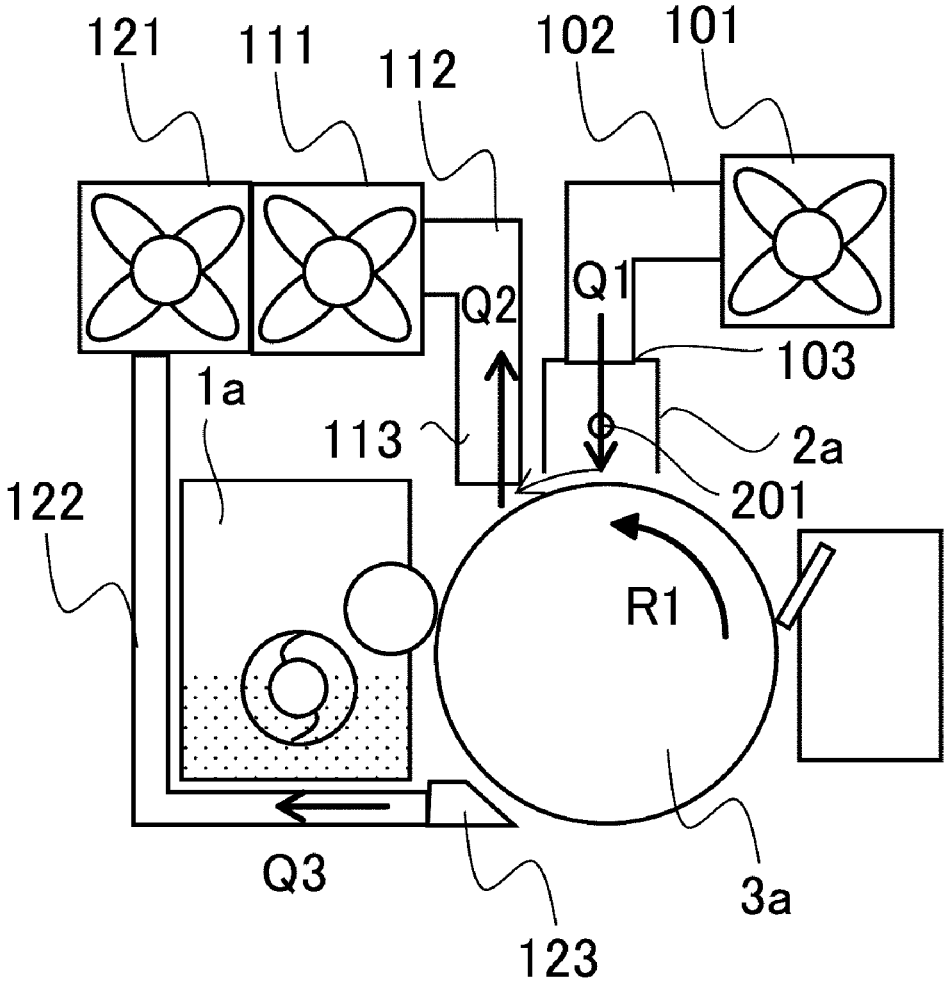
FIG. 2 is a schematic side view of an airflow configuration for an image forming unit.
Figure 3:
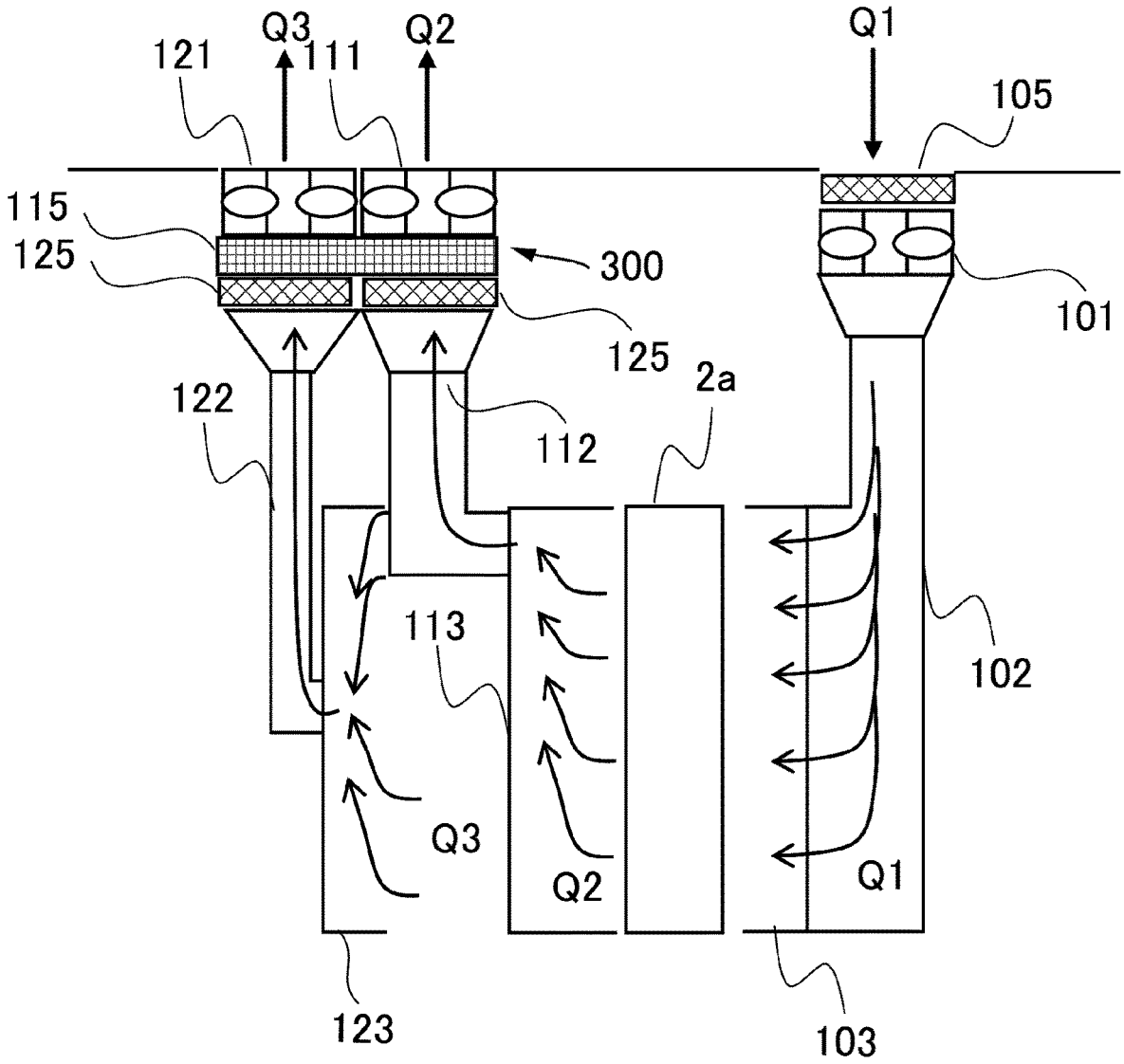
FIG. 3 is a schematic top view of an airflow configuration for an image forming portion.

Next, an air flow configuration related to the collection (filtering) of ozone generated by the charging of photosensitive drums 3*a* to 3*d* by corona discharge in charging devices 2*a* to 2*d* is explained using FIG. 2 and FIG. 3. However, in FIG. 2 and FIG. 3, charging device 2*a* is used as a representative example.

A charging device 2*a* charges a photosensitive drum 3*a* by generating ions by ionizing the air around a charging wire 201 through corona discharge. To generate ions by corona discharge, it is necessary to supply air to a charging device 2*a*. Therefore, in the vicinity of a charging device 2*a*, upstream of the rotational direction of a photosensitive drum 3*a*, a charging suction duct 102 is located to supply air to the charging device 2*a*. However, the charging device 2*a* generates not only ions but also ozone during corona discharge. Ozone may corrode the stainless steel grid (not shown) and other components of the charging device 2*a*, for example, and reduce the charging capacity of the charging device 2*a*, so it must be recovered promptly. Therefore, in order to send ozone by air to an ozone filter 115 (see FIG. 3) for collection, a charging exhaust duct 112 is located downstream of a photosensitive drum 3*a* in the rotational direction near the charging device 2*a*, as shown in FIG. 2.

The charging suction duct 102 forms an airflow path to guide air to the charging device 2*a*, and the charging intake fan 101 is located on the intake side of the charging suction duct 102. The charging suction fan 101 takes in air through the dust filter 105 (see FIG. 3) and sends the taken-in air into the charging suction duct 102. The dust filter 105 is a fibrous filter that removes dust, dirt, and other foreign matter from the air drawn in by the charging suction fan 101. The charging suction duct 102 is connected to the charging device 2*a* via the suction duct connection portion 103 on the outlet side to guide air (denoted as air Q1) after removing foreign matter to the charging device 2*a*. The suction duct connection portion 103 has a plurality of apertured air outlets (not shown) arranged longitudinally to blow air uniformly in the longitudinal direction of the charging device 2*a*.

As shown in FIG. 3, air Q1 blown from the suction duct connection portion 103 passes through the charging device 2*a*. At that time, ozone generated by corona discharge is included in the air Q1 and discharged together from the charging device 2*a* (denoted as air Q2). A charging exhaust duct 112 as the first duct forms a ventilation path to guide an ozone-containing air Q2 discharged from the charging device 2*a* through the first air suction port to an ozone filter 115, and a charging exhaust fan 111 that exhausts the air is located at the exhaust port side of the charging exhaust duct 112. The charging exhaust duct 112 is connected to the charging device 2*a* via an exhaust duct connection portion 113 to guide ozone-containing air Q2 to the ozone filter 115. The exhaust duct connection portion 113 has an opening (not shown) that spans the longitudinal direction to take in air Q2 uniformly in the longitudinal direction of the charging device 2*a*.

As described in detail below, the charging exhaust fan 111 as the first fan is installed in the duct unit 300, which consolidates exhaust air from the charging exhaust duct 112 and a developing exhaust duct 122. The ozone filter 115 is located in the duct unit 300 along with a toner filter 125 (see FIG. 4 below).

The above air Q2 containing ozone is sent from the charging exhaust duct 112 into the duct unit 300, where the ozone is collected and exhausted by the ozone filter 115 for ozone collection located in the duct unit 300. The airflow rate of a charging suction fan 101 and the airflow rate of a charging exhaust fan 111 are set so that the airflow rates of air Q1 and air Q2 described above are "Q2>Q1." In this way, more ozone can be contained in air Q2 and discharged from the charging device 2*a* than when the airflow rate is "Q2≤Q1," and ozone is less likely to remain in the charging device 2*a*. That is, the ozone generated in the charging device 2A can be properly discharged from the charging device 2*a* by air.

Next, the air flow configuration for collecting toner scattered by developing toner images in developing devices 1*a* to 1*d* will be explained using FIG. 2 and FIG. 3. In FIG. 2 and FIG. 3, the case of developing device 1*a* is taken as a representative example. For convenience of illustration, the main body of the developing device 1*a* is omitted in FIG. 3.

In the image forming apparatus 100, toner is supplied from the developing device 1*a* to the photosensitive drum 3*a* to develop the toner image. In the past, toner that was not fed to the photosensitive drum 3*a* and scattered outside the developing device 1*a* (called scattered toner) existed. This scattered toner may contaminate the image forming apparatus 100 and cause image defects. Therefore, as shown in FIG. 2, a developing exhaust duct 122 is installed near the developing device 1*a* to send the scattered toner by air to the toner filter 125 (see FIG. 3) for collection.

A developing exhaust duct 122 as the second duct forms a ventilation channel for guiding air to the outside of the image forming apparatus 100, and the intake side of the developing exhaust duct 122 is connected to the toner collection duct connection portion 123. A toner collection duct connection portion 123 is located below the developing device 1*a* and has an opening (not shown) that takes in air Q3 described below uniformly in the longitudinal direction from below the developing device 1*a*. A developing exhaust fan 121 as a second fan is located on the exhaust side of the developing exhaust duct 122. The air flow generated by the developing exhaust fan 121 causes scattered toner to be included in the air (denoted as air Q3) and exhausted from the developing device 1*a*. Air Q3 containing scattered toner is sent from the developing exhaust duct 122 into the duct unit 300, where the scattered toner is collected and exhausted by the toner filter 125 for toner collection located in the duct unit 300. The developing exhaust fan 121 is installed in the duct unit 300 together with the charging exhaust fan 111. That is, the charging exhaust fan 111 and the developing exhaust fan 121 are installed separately in the duct unit 300.

Even if the airflow rate of air Q3 described above is smaller than that of air Q1 and air Q2 described above, scattered toner can be sent to the toner filter 125 for collection. Conversely, if the airflow rate of air Q3 is increased to match that of air Q2, the increase in airflow rate of air Q3 may cause scattered toner to slip through the toner filter 125, preventing the toner filter 125 from collecting the scattered toner. An increase in the airflow of air Q3 may affect the images formed on the photosensitive drum 3. Therefore, in the present embodiment, the airflow rate of air Q3 is set to be smaller than the airflow rate of air Q2. Specifically, the blowing amount of the developing exhaust fan 121 is controlled to be smaller than the blowing amount of the charging exhaust fan 111. The developing exhaust duct 122 may be formed to have a smaller cross-sectional area than the charging suction duct 102 and the charging exhaust duct 112. The total area of the inlet of the developing exhaust duct 122 may be smaller than the total area of the inlet of the charging exhaust duct 112.

<Duct Unit>

Figure 4:
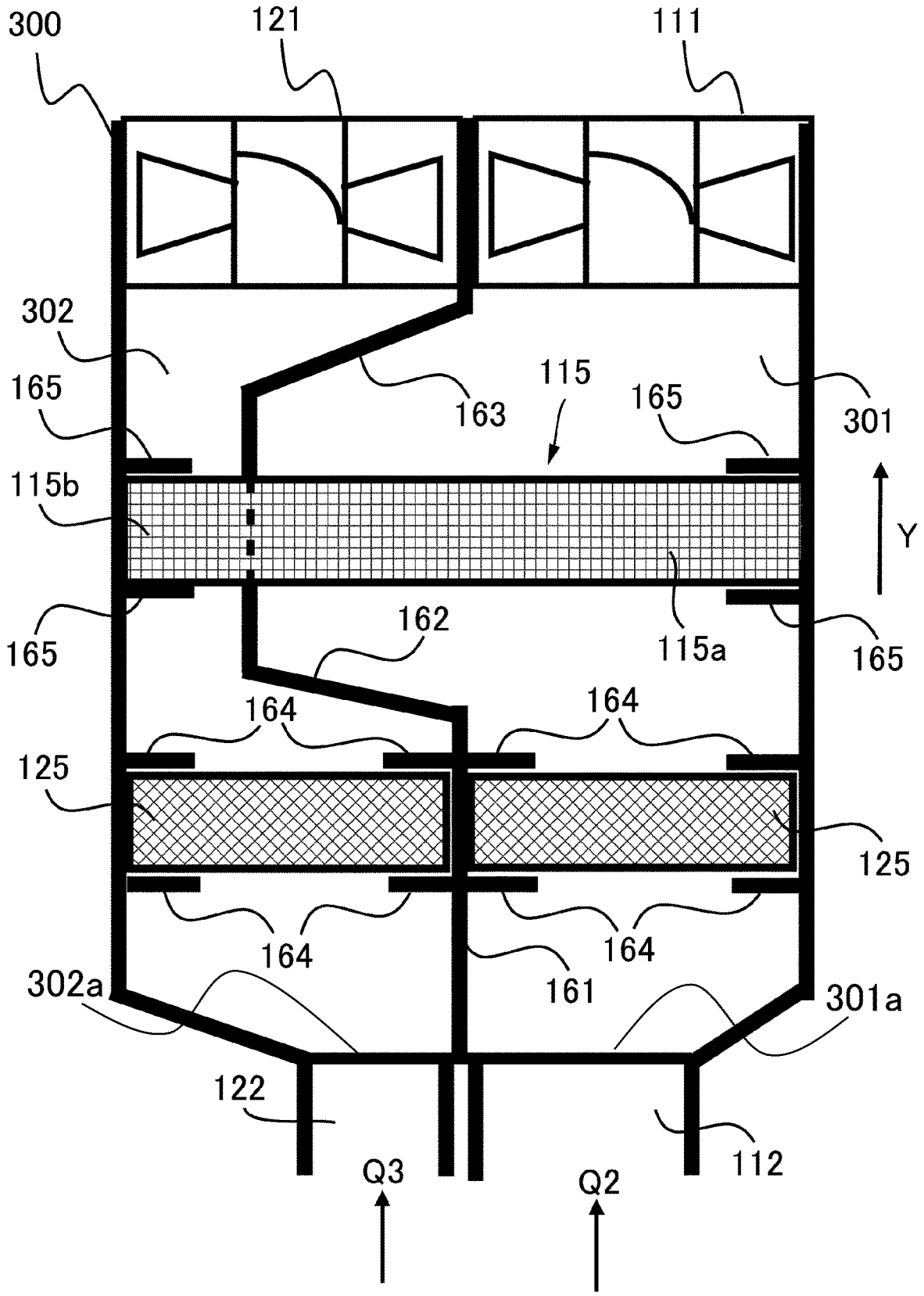
FIG. 4 is a cross-sectional view showing a duct unit.

Next, the duct unit 300 is explained using FIG. 4. The duct unit 300 is formed in an abbreviated box shape using resin such as PC-ABS. As shown in FIG. 4, the duct unit 300 is equipped with a charging exhaust fan 111 and a developing exhaust fan 121, and a charging exhaust duct 112 and a developing exhaust duct 122 are connected.

The interior of the duct unit 300 is divided by ribs 161, 162, and 163 as partition members into a charging exhaust chamber 301 as the first duct and a developing exhaust chamber 302 as the second duct. A charging exhaust chamber 301 forms a duct leading from the connecting charging exhaust duct 112 to the charging exhaust fan 111, and a developing exhaust chamber 302 forms a duct leading from the connecting developing exhaust duct 122 to a developing exhaust fan 121. In the present embodiment, a connection portion 301*a* between the charging exhaust chamber 301 and the charging exhaust duct 112 is an example of a first air suction port. A connection portion 302*a* is an example of a second air suction port between the developing exhaust chamber 302 and the developing exhaust duct 122. By dividing the interior of the duct unit 300 into ribs 161, 162, and 163, the respective airflows generated by the charging exhaust fan 111 and developing exhaust fan 121 in the duct unit 300 (inside the duct unit) do not interfere with each other.

In the duct unit 300, a toner filter 125 is installed upstream of the airflow direction (airflow direction: arrow Y direction) generated by the charging exhaust fan 111 and developing exhaust fan 121, and an ozone filter 115 is installed downstream of the toner filter 125. The toner filter 125 is provided in the charging exhaust chamber 301 and developing exhaust chamber 302, each of which is separately removable. The respective toner filters 125 are fitted into fitting portions 164 on the duct unit 300 and rib 161, and are arranged in the first and second airflows flowing through the charging exhaust chamber 301 and developing exhaust chamber 302, respectively (in the arrow Y direction) in the width direction that intersects them. In other words, the toner filter 125 provided in the charging exhaust chamber 301 filters the toner contained in the airflow Q2 generated by the charging exhaust fan 111. The toner filter 125 installed in developing exhaust chamber 302 filters the toner contained in airflow Q3 generated by developing exhaust fan 121.

The amount of scattered toner contained in the air that flows into the charging exhaust chamber 301 from the charging exhaust duct 112 is often a small amount compared to the amount of scattered toner contained in the air that flows into the developing exhaust chamber 302 from the developing exhaust duct 122. Therefore, the toner filter 125 does not need to be installed in the charging exhaust chamber 301.

In the present embodiment, a single ozone filter 115 is removably placed across the charging exhaust chamber 301 and developing exhaust chamber 302. One ozone filter 115 is fitted into a fitting portion 165 in the duct unit 300. This allows the ozone filter 115 to traverse the charging exhaust chamber 301 and developing exhaust chamber 302, the charging exhaust chamber 301 and developing exhaust chamber 302 across the first airflow and the second airflow (in the direction of arrow Y) in the width direction. Thus, the ozone filter 115 is capable of filtering ozone contained in the first airflow through the charging exhaust chamber 301 and the second airflow through the developing exhaust chamber 302. Since only one ozone filter 115 is needed, replacing the ozone filter 115 is easy, and the number of ozone filters to be stocked as spare parts as consumables can be reduced, reducing the burden of filter inventory management.

<Toner Filter>

Figure 5:
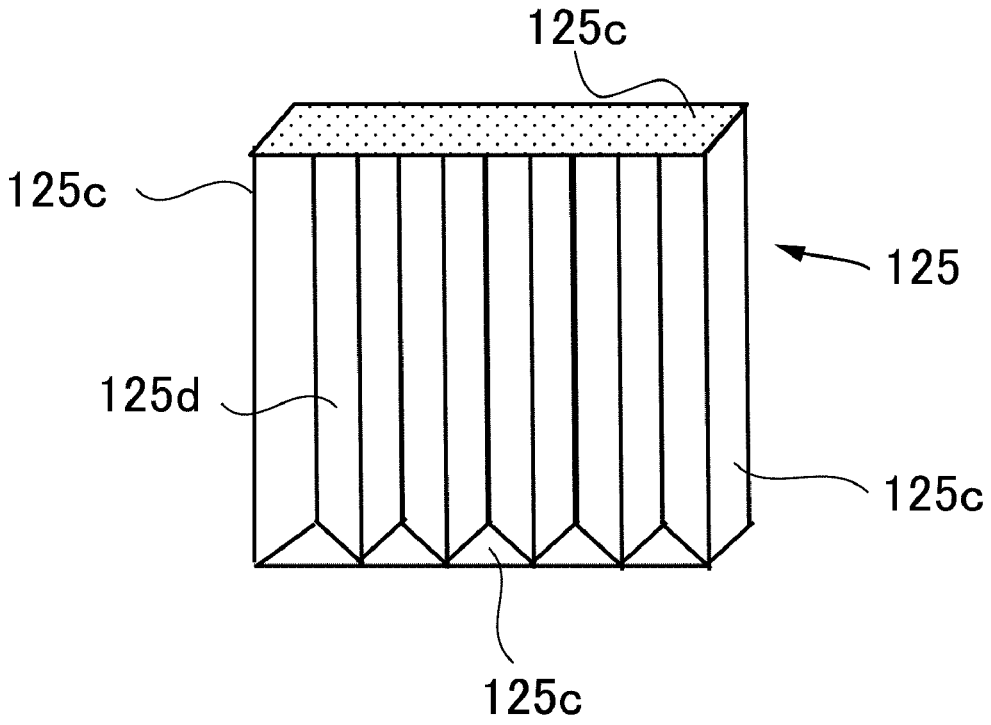
FIG. 5 is a perspective view showing a toner filter.

An example of a toner filter 125 is shown in FIG. 5. As shown in FIG. 5, the toner filter 125 is an electrostatic filter made of pleated fiber material with nonwoven fabric 125*d* folded into peaks and valleys inside an outer frame 125*c* that surrounds it on all four sides, for example. It is not limited to this as long as the toner can be collected. In the case of the present embodiment, the toner filter 125 to be installed in the charging exhaust chamber 301 and developing exhaust chamber 302 are of the same material and have the same size air passing area. If the toner filters 125 are identical, the number of toner filters to be kept in reserve as consumables can be reduced compared to the case where they are different, thus reducing the burden of filter inventory management.

<Ozone Filter>

An example of an ozone filter 115 is shown in parts (a) through (c) of FIG. 6. As shown in part (a) of FIG. 6, the ozone filter 115 has a structure that allows air to pass in the airflow direction (arrow Y direction) but not in the direction orthogonal to the airflow direction (arrow X direction). Such structures include, for example, those with vent holes that have a honeycomb structure in cross section, as shown in part (b) of FIG. 6, and those with vent holes that have a cross section similar to that of corrugated cardboard, as shown in part (c) of FIG. 6. In this configuration, even if a single ozone filter 115 is installed across the charging exhaust chamber 301 and developing exhaust chamber 302 (see FIG. 4), the respective airflows generated by the charging exhaust fan 111 and developing exhaust fan 121 within the duct unit 300 do not interfere with each other.

Returning to the explanation in FIG. 4, the air that passes through the charging exhaust chamber 301 contains more ozone than the air that passes through the developing exhaust chamber 302. Therefore, ribs 162 and 163 divide one ozone filter 115 into a first filter section 115*a* on the charging exhaust chamber 301 side (first duct side) and a second filter section 115*b* on the developing exhaust chamber 302 side (second duct side). In the present embodiment, the ozone filter 115 is effectively divided so that the air passing area (first passing area) of the first filter section 115*a* is larger than that of the second filter section 115*b* (second passing area).

The area ratio between the air passing area of the first filter section 115*a* and the air passing area of the second filter section 115*b* is set in advance for each charging device, since the ozone amount and flow rate ratios generated by each device are different. As mentioned above, the airflow of air Q3 is smaller than that of air Q2. For example, if the airflow ratio of air Q2 and air Q3 is "4:1," the area ratio of the first filter section 115*a* and the second filter section 115*b* is also set to "4:1." When the airflow ratio of air Q2 and air Q3 is "3:1," the area ratio of the first filter section 115*a* and the second filter section 115*b* is also set to "3:1". In such a case, rib 162 and rib 163 are formed. The area ratio of the first passing area to the second passing area is set to the first area ratio when the airflow ratio of the charging exhaust fan 111 and developing exhaust fan 121 is the first airflow ratio. The second area ratio is set to be larger than the first area ratio when the second airflow ratio is larger than the first airflow ratio.

Thus, one ozone filter 115 is effectively divided by ribs 162 and 163 so that the air passing area of the first filter section 115*a* is larger than the air passing area of the second filter section 115*b*. Thus, the ozone recovery rate can be increased by increasing the area through which the airflow exhausted from the charging exhaust duct 112, which contains a large amount of ozone, passes. The amount of ozone recovered by the first filter section 115*a* and the amount of ozone recovered by the second filter section 115*b* can be roughly the same. In other words, one ozone filter 115 can collect ozone evenly across the width direction. Therefore, the ozone filter 115 can be used efficiently without waste.

In the toner filter 125, the air passing area may also be changed according to the amount of scattered toner. An example of such a case is shown in FIG. 7. As shown in FIG. 7, the toner filter 125*a* on the charging exhaust chamber 301 side and the toner filter 125*b* on the developing exhaust chamber 302 side are both electrostatic filters as described above. The air passing area is different by having different widthwise lengths.

Air Q2 passing through the charging exhaust chamber 301 and air Q3 passing through the developing exhaust chamber 302 contain more scattered toner than air Q3 passing through the developing exhaust chamber 302. Therefore, rib 161 and rib 162 are arranged so that the air passing area of toner filter 125*b* in developing exhaust chamber 302 and the air passing area of toner filter 125*a* in charging exhaust chamber 301 area of the toner filter 125*a* in the developing exhaust chamber 301.

In this case, two types of consumable toner filters 125*a* and 125*b* with different air passing areas are prepared, which increases the burden of filter inventory management, etc. However, the exchange timing of the toner filter 125*a* on the charging exhaust chamber 301 side and the toner filter 125*b* on the developing exhaust chamber 302 side are roughly the same. Hence, the toner filters 125*a* and 125*b* are replaced at the same time, which reduces the downtime to stop the equipment for filter replacement compared to when they are replaced at different times.

If the charging exhaust fan 111 and developing exhaust fan 121 are shared by a single fan, the airflow for collecting ozone and the airflow for collecting scattered toner cannot be independently controlled. When using a configuration where one fan exhausts two airflows and the airflow rate of air Q2 is different from that of air Q3, the cross-sectional area of the duct must be adjusted during product design by changing the position of ribs 161, 162, and 163 in order to set the balance of the respective airflow rates. In this case, it is not easy to achieve the desired airflow rate for air Q2 and air Q3, respectively, and trial and error may occur during design, and positioning the ribs 161, 162, and 163 may take time. In addition, the toner filter 125 has a large air pressure drop as it collects toner. If the air pressure loss increases in a configuration where one fan exhausts two airflows, the exhaust will be biased toward exhaust from the charging exhaust chamber 301, which has a lower pressure loss than the developing exhaust chamber 302. The airflow required for toner collection may not be obtained, and toner may not be collected properly by the toner filter 125. Furthermore, if a single fan is shared, a larger fan with a higher air volume is needed to obtain the air volume required for toner collection in case the pressure loss increases, but fans with higher air volumes are more costly. The use of a single fan with a large air volume is more expensive than the use of two fans with a comparably small air volume. Therefore, as mentioned above, in the present embodiment, two fans of the same fan, the charging exhaust fan 111 and the developing exhaust fan 121, are installed in the duct unit 300.

In addition, nowadays it is desirable to reduce power consumption. For example, when the black monochromatic mode, in which only the black image forming portion Pd is used to form a black toner image, the developing device is stopped in the non-black image forming portions Pa, Pb, and Pc. However, the photosensitive drum is rotated and charged by the charging device. In other words, even when the black monochromatic mode is executed, the charging suction fan 101 and the charging exhaust fan 111 are rotated with respect to image forming portions Pa, Pb, and Pc other than black. If a single fan is shared, a fan with high power consumption will be rotated even though no scattered toner is produced except in black, thus consuming power unnecessarily. In contrast, the present embodiment has a charging exhaust fan 111 and developing exhaust fan 121, each of which can be individually controlled and consumes less power than the other. Therefore, power consumption can be suppressed by rotating only the charging exhaust fan 111 except in black.

The present embodiment of the image forming apparatus 100 integrates the charging exhaust duct 112, through which air containing ozone produced by the charging device passes, and the developing exhaust duct 122, through which air containing flying toner produced by the developing device passes, into the duct unit 300. The duct unit 300 is also equipped with a toner filter 125 to collect toner, an ozone filter 115 to collect ozone, and two fans, a charging exhaust fan 111 and a developing exhaust fan 121. The duct unit 300 is divided into a charging exhaust chamber 301 and a developing exhaust chamber 302 by ribs 161, 162, and 163. Only one ozone filter 115 is located across the duct unit 300, spanning the charging exhaust chamber 301 and developing exhaust chamber 302. Ribs 161, 162, and 163 divide the filter into a first filter section 115*a* on the charging exhaust chamber 301 side and a second filter section 115*b* on the developing exhaust chamber 302 side. Thus, the ribs 161, 162, 163 (partition members) divide the airflow generated by the charging exhaust fan 111 and the developing exhaust fan 121 in the duct unit 300 into the charging exhaust chamber 301 and developing exhaust chamber 302. The ribs 161, 162, and 163 (partition members) divide a single ozone filter 115. In this way, the airflow through the charging exhaust chamber 301 is adjusted by the charging exhaust fan 111. In addition, it is easy to adjust the airflow through the developing exhaust chamber 302 by using the developing exhaust fan 121.

The same air volume fan may be used for the charging exhaust fan 111 and the developing exhaust fan 121. As mentioned above, since developing exhaust duct 122 is formed with a smaller cross-sectional area than charging exhaust duct 112, if a fan with the same airflow rate is used, the airflow rate will be smaller than that of charging exhaust duct 112 due to air pressure loss. Alternatively, the charging exhaust fan 111 and developing exhaust fan 121 may use the same fan with variable airflow. The respective airflows generated by the charging exhaust fan 111 and developing exhaust fan 121 in the duct unit 300 do not interfere with each other. Therefore, the rotation speeds of the charging exhaust fan 111 and developing exhaust fan 121 can be independently controlled according to the situation, and the respective airflow rates can be set to be suitable for ozone and toner recovery.

It is preferable to use the same size fan for the charging exhaust fan 111 and developing exhaust fan 121. If fans of different sizes are used, as shown in part (a) of FIG. 8, a die with a complicated shape is required to form the duct unit 300 to enclose the four sides, which increases costs, and sealing the gaps is difficult and may cause air leaks. In contrast, when the same size fan is used, as shown in part (b) of FIG. 8, the duct unit 300 can be formed with a relatively simple shape, which reduces costs because a die with a complex shape is not required, and sealing gaps is easier and air leaks are less likely to occur.

<Control Portion>

As shown in FIG. 1, the image forming apparatus 100 of the present embodiment has a control portion 900. The control portion 900 is explained using FIG. 9 with reference to FIG. 4. However, the control portion 900 is connected to various devices such as motors and power supplies for operating the image forming apparatus 100 in addition to those shown in the figure, but since this is not the main purpose of the invention, the figures and descriptions of these devices are omitted here.

The control portion 900 as a control unit controls various aspects of the image forming apparatus 100, such as image forming operations, and has, for example, a CPU 901 (Central Processing Unit) and a memory 902. The memory 902 is composed of ROM (Read Only Memory) and RAM (Random Access Memory). The memory 902 stores various programs and various data for controlling the image forming apparatus 100. CPU 901 can execute various programs stored in memory 902 and can operate image forming apparatus 100 by executing various programs. In the present embodiment, CPU 901 can execute the "image forming job processing (program)" (not shown) and "filter replacement notification processing (program)" (see FIG. 10 below) stored in memory 902. The memory 902 can also temporarily store the results of calculations and other operations associated with the execution of various programs.

The control portion 900 is connected to the operating portion 400 via an input/output interface. The operating portion 400 is a touch panel with a display that can show, for example, a screen for executing various programs such as image forming jobs, a screen for inputting various data, and a screen for reporting the replacement of ozone filters and toner filters, although these screens are omitted from the illustration.

The control portion 900 is further connected to the charging suction fan 101, charging exhaust fan 111, and developing exhaust fan 121 via input/output interfaces. The control portion 900 drives a motor (not shown) to rotate and operate the charging suction fan 101, the charging exhaust fan 111, and the developing exhaust fan 121. The control portion 900 can control the rotation speed of the charging suction fan 101, the charging exhaust fan 111, and the developing exhaust fan 121 to change the air volume according to the usage conditions. The control portion 900 can also independently control the ON/OFF switching of the charging suction fan 101, the charging exhaust fan 111, and the developing exhaust fan 121. In other words, the control portion 900 can control the charging suction fan 101, the charging exhaust fan 111, and the developing exhaust fan 121 independently, and can control the rotation start timing, rotation stop timing, and rotation speed individually. This allows the blowing amount of airflow Q2 generated by the charging exhaust fan 111 to be more than the blowing amount of airflow Q3 generated by the developing exhaust fan 121. It can also accommodate cases where independent control of the charging exhaust fan 111 and developing exhaust fan 121 is required depending on the environment in which the image forming apparatus 100 is installed. For example, if the image forming apparatus 100 is installed in a hot and humid environment, the ozone will easily corrode the grid, so the blowing amount of the charging suction fan 101 must be increased to improve the removal efficiency of the ozone on the grid. Then, to increase the blowing amount of the charging suction fan 101, the blowing amount of the charging exhaust fan 111 must also be increased to ensure that ozone is introduced into the charging exhaust duct 112. In contrast, developing exhaust fan 121 does not have to increase blowing amount even when image forming apparatus 100 is installed in a hot and humid environment. Thus, even if the blowing amount required for the ozone recovery airflow and the scattered toner recovery airflow are different, the present embodiment can control the blowing amount of each airflow appropriately because the charging exhaust fan 111 and developing exhaust fan 121 can be controlled independently, the blowing amount of each airflow can be controlled appropriately. If the maximum blowing amount of airflow generated by the charging exhaust fan 111 during image forming operation can be greater than the maximum blowing amount of airflow generated by the developing exhaust fan 121 If the maximum blowing amount of airflow generated by the developing exhaust fan 111 during image forming operation is greater than the maximum blowing amount of airflow generated by the charging exhaust fan 121, the timing for starting the rotation of the developing exhaust fan 121 may be earlier than that of the charging exhaust fan 111.

When an instruction to start an image forming job is given from operating portion 400, the control portion 900 (CPU 901 in detail) executes the "image forming job processing" stored in memory 902. The control portion 900 controls the image forming apparatus 100 based on the execution of "image forming job processing" and also counts the cumulative number of sheets of recording material S that have been formed (count portion 903). In the case of the present embodiment, the control portion 900 informs the ozone filter and toner filter of the exchange timing based on the counted cumulative number of recording material S. When the cumulative number of recording material S reaches a predetermined threshold, the control portion 900 notifies the ozone filter and toner filter of the exchange timing by displaying the information on the operating portion 400 as the notifying portion. The threshold values used to report the exchange timing are set for each ozone filter and toner filter, and are stored in memory 902 in advance.

<Replacement Notification Process>

FIG. 10 shows an example of the "filter replacement notification process" executed by the control portion 900. The filter replacement notification process is initiated by the control portion 900 when the power of the image forming apparatus 100 is turned on, and is terminated when the power of the image forming apparatus 100 is turned off.

As shown in FIG. 10, the control portion 900 determines whether the cumulative total of the counted recording material S has reached the predetermined threshold (S101), and if the cumulative total of the counted recording material S reaches the predetermined threshold (Yes in S101), the control portion 900 proceeds to step Proceed to step S102. The control portion 900 displays on the operating portion 400 that it is exchange timing for the ozone filter or toner filter as the process of step S102. When the ozone filter or toner filter is replaced by a service person or user, the control portion 900 resets the threshold value used to report the exchange timing of the replaced ozone filter or toner filter (S103). The control portion 900 stops displaying the fact that it is exchange timing for the ozone filter or toner filter (S104).

As described above, the present embodiment informs the user of the exchange timing of the ozone filter or toner filter. The user or service person can replace the ozone filter or toner filter according to the reported exchange timing. However, the life of the toner filter differs between the charging exhaust chamber 301 and the developing exhaust chamber 302 because of the larger amount of toner in the developing exhaust chamber 302 side. Therefore, it is preferable to change the threshold for reporting the exchange timing for each filter (the cumulative number of recording materials S mentioned above) so that the appropriate exchange timing can be reported for each filter. This will prevent ozone filters and toner filters from being replaced unnecessarily.

Other Embodiments

In the embodiment described above, the case in which the toner filter 125 is located in the duct unit 300 is shown (see FIG. 3), but it is not limited to this case. For example, the toner filter 125 may be located in the developing exhaust duct 122.

In the embodiment described above, the charging exhaust fan 111 and developing exhaust fan 121 are arranged side by side as seen from the top surface, but this is not limited to this. For example, in a color electrophotographic apparatus, at least four colors of image forming portions Pa to Pd are lined up in a row, and the space between the image forming portions Pa to Pd of each color may be too small to provide space for air flow. In such a case, the charging exhaust fan 111, developing exhaust fan 121, and ducts (112, 122) can be arranged vertically to secure airflow space.

In the embodiments described above, the intermediate transfer type image forming apparatus 100, in which the toner image is secondary transferred from the intermediate transfer belt 20 to the recording material S after the primary transfer of the toner image from the photosensitive drums 3*a*-3*d* of each color to the intermediate transfer belt 20, is described as an example. However, it is not limited to this. The above-described embodiment can also be applied to an image forming apparatus of the direct transfer method, in which the toner image is directly transferred from the photosensitive drums 3*a*-3*d* of each color carrying the toner image and rotating to the recording material S.

According to the present invention, even if the filters that pass through the airflow to exhaust air near the corona charging device and the airflow to exhaust air near the developing device are common, it is easy to control each airflow individually.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2021-119206 filed on Jul. 20, 2021 and 2022-088180 filed on May 31, 2022, which are hereby incorporated by reference herein in their entirety.

What is claimed is:

1. An image forming apparatus for forming an image on a recording material comprising:

an image forming unit provided with a photosensitive member to be rotationally driven, a corona charging device for charging the photosensitive member, an exposing device for forming an electrostatic latent image on the charged photosensitive member, and a developing device for developing the electrostatic latent image formed on the photosensitive member by using toner into a toner image;

a first air suction port configured to suck an air containing ozone generated by charging of the photosensitive member by the charging device;

a second air suction port configured to suck an air containing the toner scattered when the developing device develops the electrostatic latent image;

a duct unit configured to guide the air sucked by the first air suction port and the second air suction port to an outside of the image forming apparatus, the duct including a first duct communicating with the first air suction port and a second duct communicating with the second air suction port;

a first fan configured to generate a first air flow inside the first duct to suck the air from the first air suction port;

a second fan configured to generate a second air flow inside the second duct to suck the air from the second air suction port;

an ozone filter detachably provided to both the first duct and the second duct, disposed straddling the first duct and the second duct, and configured to filter the ozone contained in the first air flow and the second air flow; and a partition member configured to partition the duct unit so that a first passing area of the air to the ozone filter in the first duct and a second passing area of the air to the ozone filter in the second duct are different from each other.

2. An image forming apparatus according to claim 1, wherein a blowing amount of the first fan is larger than a blowing amount of the second fan, and wherein the first passing area is larger than the second passing area.

3. An image forming apparatus according to claim 1, wherein a blowing amount of the first fan is larger than a blowing amount of the second fan.

4. An image forming apparatus according to claim 1, further comprising a third fan configured to generate a third air flow toward the charging device, wherein a blowing amount of the first fan is larger than a blowing amount of the third fan.

5. An image forming apparatus according to claim 1, further comprising a toner filter detachably provided to the first duct and configured to filter the toner contained in the first air flow, wherein the toner filter is provided upstream of the ozone filter with respect to the first air flow.

6. An image forming apparatus according to claim 1, further comprising a toner filter detachably provided to the second duct and configured to filter the toner contained in the first air flow, wherein the toner filter is provided upstream of the ozone filter with respect to the second air flow.

7. An image forming apparatus according to claim 5, wherein the toner filter is an electrostatic filter formed of a nonwoven fabric.

8. An image forming apparatus according to claim 1, wherein the ozone filter does not permit the air to pass through in a direction perpendicular to the first air flow, and does not permit the air to pass through in a direction perpendicular to the second air flow.

9. An image forming apparatus according to claim 8, wherein the ozone filter includes vent holes of honeycomb structure in cross section.

10. An image forming apparatus according to claim 1, further comprising:

a count portion configured to count a cumulative number of the recording material on which the image is formed; and a notifying portion configured to notify a exchange timing of the ozone filter based on the cumulative number of the recording material counted by the count portion.

11. An image forming apparatus for forming an image on a recording material comprising:

an image forming unit provided with a photosensitive member to be rotationally driven, a corona charging device for charging the photosensitive member, an exposing device for forming an electrostatic latent image on the charged photosensitive member, and a developing device for developing the electrostatic latent image formed on the photosensitive member by using toner into a toner image;

a first air suction port configured to suck an air containing ozone generated by charging of the photosensitive member by the charging device;

a second air suction port configured to suck an air containing the toner scattered when the developing device develops the electrostatic latent image;

a duct unit configured to guide the air sucked by the first air suction port and the second air suction port to an outside of the image forming apparatus, the duct including a first duct communicating with the first air suction port and a second duct communicating with the second air suction port;

a first fan configured to generate a first air flow inside the first duct to suck the air from the first air suction port;

a second fan configured to generate a second air flow inside the second duct to suck the air from the second air suction port;

an ozone filter detachably provided to both the first duct and the second duct, disposed straddling the first duct and the second duct, and configured to filter the ozone contained in the first air flow and the second air flow; and a third fan configured to generate a third air flow toward the charging device, wherein a blowing amount of the first fan is larger than a blowing amount of the third fan.

12. An image forming apparatus according to claim 11, further comprising a partition member configured to partition the duct unit so that a first passing area of the air to the ozone filter in the first duct and a second passing area of the air to the ozone filter in the second duct are different from each other.

13. An image forming apparatus according to claim 12, wherein a blowing amount of the first fan is larger than a blowing amount of the second fan, and wherein the first passing area is larger than the second passing area.

14. An image forming apparatus according to claim 11, wherein a blowing amount of the first fan is larger than a blowing amount of the second fan.

15. An image forming apparatus according to claim 11, further comprising a toner filter detachably provided to the first duct and configured to filter the toner contained in the first air flow, wherein the toner filter is provided upstream of the ozone filter with respect to the first air flow.

16. An image forming apparatus according to claim 11, further comprising a toner filter detachably provided to the second duct and configured to filter the toner contained in the first air flow, wherein the toner filter is provided upstream of the ozone filter with respect to the second air flow.

17. An image forming apparatus according to claim 15, wherein the toner filter is an electrostatic filter formed of a nonwoven fabric.

18. An image forming apparatus according to claim 11, wherein the ozone filter does not permit the air to pass through in a direction perpendicular to the first air flow, and does not permit the air to pass through in a direction perpendicular to the second air flow.

19. An image forming apparatus according to claim 18, wherein the ozone filter includes vent holes of honeycomb structure in cross section.

20. An image forming apparatus according to claim 11, further comprising:

a count portion configured to count a cumulative number of the recording material on which the image is formed; and a notifying portion configured to notify a exchange timing of the ozone filter based on the cumulative number of the recording material counted by the count portion.

* * * * *